US010870800B2

(12) United States Patent
Gu et al.

(10) Patent No.: US 10,870,800 B2
(45) Date of Patent: Dec. 22, 2020

(54) COKER-FRACTIONATOR UNIT AND PROCESS FOR OPERATING SAME

(71) Applicant: Suncor Energy Inc., Calgary (CA)

(72) Inventors: Mingxing Gu, Calgary (CA); Michael Goulding, Calgary (CA); Jin Jiang Zhang, Calgary (CA); Hieu Tran, Calgary (CA)

(73) Assignee: Suncar Energy Inc., Calgary (CA)

( * ) Notice: Subject to any disclaimer, the term of this patent is extended or adjusted under 35 U.S.C. 154(b) by 55 days.

(21) Appl. No.: 15/963,364

(22) Filed: Apr. 26, 2018

(65) Prior Publication Data

US 2018/0312761 A1 Nov. 1, 2018

(51) Int. Cl.

| | |
|---|---|
| ***C10G 11/00*** | (2006.01) |
| ***C10G 11/18*** | (2006.01) |
| ***C10G 9/00*** | (2006.01) |

(52) U.S. Cl.

CPC ..... *C10G 11/18* (2013.01); *C10G 9/002* (2013.01); *C10G 9/005* (2013.01); *C10G 2300/1044* (2013.01); *C10G 2300/805* (2013.01)

(58) Field of Classification Search

CPC ..... C10G 11/18; C10G 9/005; C10G 9/002; C10G 2300/1044; C10G 2300/805

See application file for complete search history.

(56) References Cited

U.S. PATENT DOCUMENTS

| | | | | |
|---|---|---|---|---|
| 5,185,077 | A | 2/1993 | Owen | |
| 6,758,945 | B1 * | 7/2004 | Haik | C10B 55/00 201/1 |
| 2014/0061100 | A1 * | 3/2014 | Lattner | C10G 75/00 208/48 Q |

FOREIGN PATENT DOCUMENTS

| | | |
|---|---|---|
| CA | 1184524 | 3/1985 |
| CA | 2421947 | 3/2002 |
| GB | 1309309 | 3/1973 |
| WO | 2008/020053 | 2/2008 |
| WO | 2016/024244 | 2/2016 |

* cited by examiner

*Primary Examiner* — Prem C Singh
*Assistant Examiner* — Brandi M Doyle
(74) *Attorney, Agent, or Firm* — Gowling WLG (Canada) LLP

(57) ABSTRACT

A process for operating a thermal or catalytic cracking unit is described. The process entails generating a product that includes cracked hydrocarbon vapor and solid coke-particles from a heavy hydrocarbon input. The product is communicated towards a fractionator and a quench liquid is introduced into the product for creating a two-phase flow of cracked hydrocarbon vapor and the quench liquid with solid coke-particles entrained in the quench liquid. The two-phase flow is introduced into the fractionator and the cracked hydrocarbon vapor are separated from the quench liquid and the solid coke-particles entrained therein by gravity separation. The two-phase flow can reduce or remove the requirement of a wash zone within the fractionator. A recirculation loop is included in a wash-zone circulation system. The recirculation loop bypasses one or more spray headers of the wash zone and returns to a first end of the wash-zone circulation system.

11 Claims, 4 Drawing Sheets

COKER-FRACTIONATOR UNIT AND PROCESS FOR OPERATING SAME

TECHNICAL FIELD

This disclosure generally relates to thermal or catalytic cracking of heavy hydrocarbons for producing desired hydrocarbon outputs from a fractionator.

BACKGROUND

Thermal cracking of heavy hydrocarbon includes at least delayed coking, fluid coking and fluid catalytic cracking methods. In one example of a delayed coking process, a coker-fractionator unit typically includes multiple coker drums and a fractionator. The coker drums receive a heavy hydrocarbon input and provide a residence time at temperatures that are suitable for coking the heavy hydrocarbon input, which is also referred to as thermal cracking. The thermal cracking produces a vapor product and a solid product. The multiple coker drums allow the coking process to be offset between the coker drums so there is time to clean the accumulated solid product out of a given coker drum while at least another drum is actively coking. In this fashion at least one coker drum is always producing the vapor product.

The vapor product contains cracked hydrocarbons that are directed to a fractionator by a cracked hydrocarbon vapors line (CVL). A large proportion of the solid product, which is also referred to as coke, accumulates in the drum. However, some coke becomes entrained within the vapor product that is conducting through the CVL to the fractionator.

The vapor products and the entrained coke pass to the fractionator for boiling-point separation into various desired hydrocarbon products. A wash zone is typically provided within a lower section of the fractionator. The wash zone is intended to strip the entrained coke solids and any heavy hydrocarbons (high boiling point hydrocarbon) from the hydrocarbon vapors that are ascending the fractionator. The stripping also controls fouling of the upper portion of the fractionator where the boiling point separation occurs.

The wash zone is typically regarded as a critical component of the fractionator. The wash zone can include one or more rings of spray headers to ensure a suitable washing capacity to strip the coke from the vapor products. However, over time coke can escape the wash zone and foul upper portions of the fractionator. Of particular importance the coke can end up fouling circulation loops that feed the wash zone. This often results in plugging of the spray headers and reduced functionality of the wash zone. Reduced functionality of the wash zone can exacerbate the fouling, impair the fractionator operations and result in the fractionator's desired hydrocarbon products not meeting required specifications for downstream refinery processes.

SUMMARY

Some implementations of the present disclosure relate to a process for operating a coker-fractionator unit. The method comprises the steps of: generating a coker product that comprises a cracked hydrocarbon vapor and solid coke-particles; introducing a quench liquid into the coker product such that a two-phase flow is generated comprising the cracked hydrocarbon vapor and the quench liquid, wherein at least some of the solid coke-particles become entrained in the quench liquid; providing the two-phase flow into a fractionator; and separating the cracked hydrocarbon vapor from the quench liquid and the solid coke-particles entrained therein.

Some implementations of the present disclosure relate to a coker fractionator unit that comprises at least one coker drum, a fractionator and a cracked hydrocarbon vapor line (CVL). The at least one coker drum is for receiving and thermally cracking a hydrocarbon input for producing a cracked hydrocarbon vapor and solid coke-particles. The fractionator is for receiving the cracked hydrocarbon vapor and the solid coke-particles. The fractionator comprises: a lower zone; a wash zone for creating a curtain of wash liquids that is directed towards the lower zone; a capture zone for capturing heavy hydrocarbons that ascend upwardly through the fractionator beyond the wash zone; a separation zone for separating the cracked hydrocarbon vapor into desirable hydrocarbon products; and a wash-zone circulation loop that provides fluid communication between a first end that is in fluid communication with the capture zone and a second end that is in fluid communication with the wash zone. The wash-zone circulation loop comprises at least one filter positioned between the first end and the second end and a recirculation loop that bypasses one or more spray headers and returns to the first end. The CVL is for providing fluid communication of the cracked hydrocarbon vapor and solid coke-particles between the at least one coker drum and the lower zone, the CVL also for receiving a quench liquid at a rate that causes a heat transfer and a mass transfer within the CVL.

Some implementations of the present disclosure relate to a coker fractionator unit that comprises: at least one coker drum, a fractionator and a CVL. The at least one coker drum is for receiving and thermally cracking a hydrocarbon input for producing a cracked hydrocarbon vapor and solid coke-particles. The fractionator is for receiving the cracked hydrocarbon vapor and the solid coke-particles. The fractionator consists of: a lower zone; a capture zone for capturing heavy hydrocarbons that ascend upwardly from the lower zone through the fractionator; and a separation zone for separating the cracked hydrocarbon vapor into desirable hydrocarbon products. The CVL is for providing fluid communication of the cracked hydrocarbon vapor and solid coke-particles between the at least one coker drum and the lower zone. The CVL is also for receiving a quench liquid at a rate that causes a heat transfer and a mass transfer within the CVL. The lower zone receives some or substantially most or substantially all of the solid-coke particles entrained within the quench liquid, and the fractionator does not have a wash zone.

Without being bound by any particular theory, implementations of the present disclosure relate to increased quench flow rates to such an extent that there is a two-phase CVL product that enters the fractionator. The two-phase CVL product is made up of a vapor phase and a liquid phase. The vapor phase is substantially lighter-hydrocarbon vapors that are desirable for separation into fractionator products. The liquid phase is made up of quench liquids and coke particles that are entrained therein. The liquid phase and the coke particles therein can settle within the lower section of the fractionator without requiring any wash zone spray.

BRIEF DESCRIPTION OF THE DRAWINGS

These and other features of the present disclosure will become more apparent in the following detailed description in which reference is made to the appended drawings.

DETAILED DESCRIPTION

As used herein, the term "about" refers to an approximately +/−10% variation from a given value. It is to be understood that such a variation is always included in any given value provided herein, whether or not it is specifically referred to.

Implementations of the present disclosure will now be described by reference to FIG. 1 through to FIG. 4, which show examples of coker-fractionator units and processes for operating a thermal cracking system according to the present disclosure.

Figure 1:
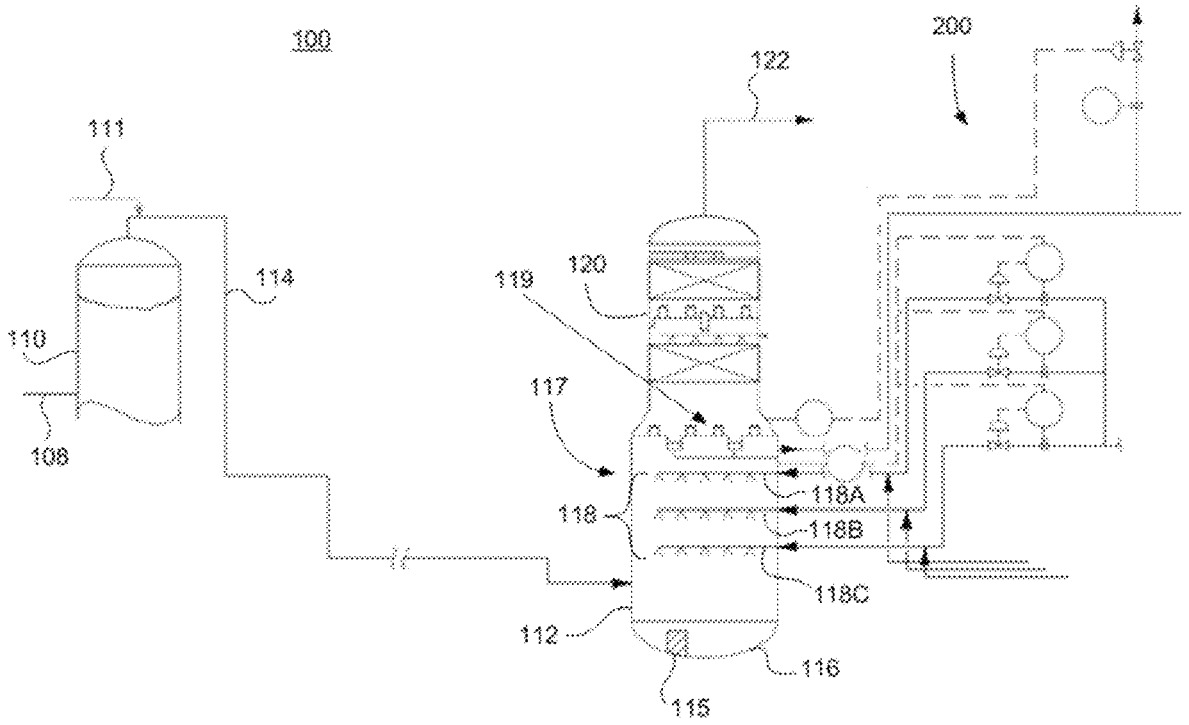
FIG. 1 is a schematic diagram that shows an example of a coker-fractionator unit.

FIG. 1 shows a thermal cracking system with an example of a coker-fractionator unit 100 is provided. The coker-fractionator unit 100 includes at least one coker drum 110, a fractionator 112 and a cracked hydrocarbon vapors line (CVL) 114 that provides fluid communication between the two. The thermal cracking system can be any of the following types: a delayed coker system, a fluid coker system, a fluid catalytic cracking system or any other type of thermal cracking system that is used in a hydrocarbon refinery. For fluid catalytic cracking units, it is understood that a reactor is typically used in place of a coker drum. While FIG. 1 shows only one coker drum 110, there can be multiple coker drums present with each in fluid communication with the fractionator 112 through one or more CVLs 114.

The coker drum receives a heated coker input stream 108 from an upstream process within the hydrocarbon refinery or refining process. The coker input steam 108 referred to herein can also refer to an input stream that is sourced from an upstream process that processes vacuum topped bitumen, atmospheric topped bitumen, other sources of bitumen, oil and/or gas or combinations thereof. The coker input stream 108 can also refer to a reactor input stream for a fluid catalytic cracking system. The coker input stream 108 contains various hydrocarbon components from which desirable hydrocarbon products that can be isolated by processing in the coker-fractionator unit 100.

Within the coker drum 110, the coker input stream 108 is soaked to produce coker product through a thermal-cracking process. The coker product is made up of cracked hydrocarbon vapor and solid coke-particles, the cracked hydrocarbon vapor can also be referred to as a cracked hydrocarbon vapors product or coker drum effluent. The cracked hydrocarbon vapor may include a wide range of constituents including non-hydrocarbons and hydrocarbons. The non-hydrocarbons constituents can include, but are not limited to: hydrogen ($H_2$) and hydrogen sulfide ($H_2S$). The hydrocarbons constituent within the cracked hydrocarbon vapor can include, but are not limited to: methane ($CH_4$), $C_2$ to $C_4$ hydrocarbons, a naphtha fraction, a kero fraction, and a gas oil fraction. The boiling point of the hydrocarbon constituents of the cracked hydrocarbon vapor can be as high as 1000 degrees Fahrenheit (° F.).

The solid coke-particles can also be referred to as coke or petroleum coke. The solid coke-particles include micro-carbon content that reflects the amount of heavy hydrocarbons with a high coking tendency. There are two types of micro-carbon. One type is referred to as distillable micro-carbon, which is generated by the hydrocarbons that are vaporized at the coker-fractionator unit's 100 normal operating temperatures. The other type of micro-carbon is referred to as non-distillable micro-carbon, which is generated either by the hydrocarbons that cannot be distilled due to a high boiling-temperature, the presence of a multi-ringed structure, or the non-distillable micro-carbon can also be the coke fine itself. The non-distillable micro-carbon can end up in fractionator hydrocarbon products, as described further below, due to carry-over or entrainment within vapor streams within the coker-fractionator unit 100.

The coker vapor exits the coker drum 110 by the CVL 114, which provides fluid communication for the coker vapor to move into the fractionator 112. In some implementations of the present disclosure, the CVL 114 can be between 500 and 2000 feet long (one foot is equal to about 0.305 meters). In some implementations of the present disclosure, the majority of the solid coke-particles remain within the coker drum 110 but at least a portion of the solid coke-particles can become entrained within the stream of cracked hydrocarbon vapor into the CVL 114. In some examples of coker-fractionator units 100, the contents of the CVL 114 have a temperature of about 900° F. (which is equal to about 480 degrees Celsius (° C.)) and a pressure of about 40 pounds per square inch gauge (psig, which is substantially equal to about 377 kilo-Pascals).

FIG. 1 shows a quench input line 111 that is in fluid communication with the CVL 114. The quench input line 111 provides a fluid stream of hydrocarbon liquids that are similar hydrocarbons as the gas oil fraction, which can have a 95% point at about 940° F. The term "95% point" refers a temperature (either ° F. or ° C.) at which 95% of the volume or weight of a liquid hydrocarbon product would be boiled off as vapor in true boiling point (TBP) or based upon D2887 testing. This fluid stream can be referred to herein as the quench liquid. In the coker-fractionator unit 100, the quench liquid can be added at a first rate so that the temperature of the contents of the CVL 114 decreases by about 20° F. to about 40° F. through the length of the CVL 114. The quench liquid induced temperature change is intended to decrease any further thermal cracking or secondary reactions of the cracked hydrocarbon vapors within the CVL 114. The quench liquid is also intended to reduce fouling of the CVL 114 and to conserve the valuable portion of the coker product.

When the quench liquid is added at the first rate, there is a heat transfer that occurs whereby the cracked hydrocarbon vapors and solid coke-particles are cooled and the quench liquid is heated. At the first rate of introducing the quench liquid, the quench liquid is heated until the quench liquid vaporizes within the CVL 114. When the quench liquid is introduced into the CVL 114 at the first rate, the CVL 114 provides a first rate CVL input into the fractionator 112 that has a state of matter that is primarily a vapor with solid coke-particles entrained therein. The first rate CVL input can be referred to herein as a single-phase flow. The first rate CVL input is made up of cracked hydrocarbon vapor and quench liquid vapor with the solid coke-particles interspersed between the two vapor types. When the first rate CVL input exits the CVL 114 and enters the fractionator 112 the cracked hydrocarbon vapor, the quench liquid vapor and at least a portion of the solid coke-particles entrained therein can ascend upwardly through the fractionator 112.

The fractionator 112 has a lower zone 116, a wash zone 117, a capture zone 119 and a separation zone 120. Together the lower zone 116 and the wash zone 117 can also be referred to as a preflash section. The lower zone 116 is also referred to as an open vapor-liquid-solids knock-out zone. The CVL 114 communicates the first rate CVL input into the lower zone 116. FIG. 1 shows three sets of spray headers with an upper spray header 118A, a middle spray header 118B and a lower spray header 118C, which can be collectively referred to herein as spray headers 118. The number of sets of spray headers can be more or less than what is shown in FIG. 1. The spray headers 118 create a curtain of hydrocarbon wash liquids that is directed towards the lower zone 116. In some implementations of the present disclosure the hydrocarbon wash liquids are substantially the same types of heavy hydrocarbon as those used as the quench liquid. The curtain of hydrocarbon liquids prevents at least a portion of the quench liquid vapors from ascending past the wash zone 117. The curtain of heavy hydrocarbon wash liquids can cool and liquefy the quench liquid vapors. The curtain of hydrocarbon liquids also washes a portion of the solid coke-particles within the first rate CVL input down towards the lower zone 116. Any solid coke-particles, heavy hydrocarbon wash liquids and any liquefied quench liquid vapors within the lower zone 116 can be removed from the fractionator 112 by one or more ports 115 for further processing.

In typical operations, the spray headers 118 inject the heavy hydrocarbon wash liquids in a downward direction to create the curtain of cold liquids that is in the form of small droplets that cover the entire cross-section of the lower zone 116. Within the lower zone 116 these droplets contact the hot ascending cracked hydrocarbon vapor and the hot quench liquid vapor. While passing through the curtain the heavier quench liquid vapor condenses and becomes liquid droplets while liquid gas oil vaporizes—a heat and mass transfer takes place.

At the same time liquid-and-solids coalescing takes place when the curtain droplets contact the first rate CVL input. As a result, the liquid droplets that contain solid coke-particles can increase in aggregated size and precipitate out within the lower zone 116.

Any of the quench liquid vapors that escape the wash zone 117 can be captured in the capture zone 119, for example through a bubble trap or other known mechanisms. At least some of the captured quench liquid vapors or other hydrocarbon vapors of a similar hydrocarbon chain weight will leave the fractionator 112 and enter into a wash-zone circulation loop 200, as discussed further below.

The cracked hydrocarbon vapors can ascend through the fractionator 112 through the wash zone 117, through the capture zone 119 and enter the separation zone 120 that is at or near the top of the fractionator 112. Within the separation zone 120 the coke vapors are separated into various fractionator hydrocarbon products by boiling-point separation or other known methods. For example, the temperature decreases from the lower zone 116 towards the top of the fractionator 112 and therefore, there are different temperatures at different vertical heights of the fractionator 112. Based upon the midpoint of the range of boiling points of each fractionator products: gas oil (GO) products can be isolated at a vertical level of the fractionator 112 where the temperature is about 640° F.; naptha fractionator products can be isolated towards the top of the fractionator 112 where the temperature is about 300° F.; kerosine fractionator products and heavy naptha fractionator products can be isolated therebetween. FIG. 1 shows a product stream line 122 that represent all of the various fractionator hydrocarbon products but it is understood that each of the different types of fractionator hydrocarbon products leave the fractionator 112 by separate product stream lines at different vertical heights of the fractionator 112.

The purpose of the wash zone 117 is that the ascending vapors become lighter and cleaned of solid coke-particles. This is required so that the fractionator hydrocarbon product can meet predetermined specifications of 95% point and solid coker particle content. If the fractionator hydrocarbon product has too high of a coker particle content then that can upset downstream hydro-treaters and other processes and equipment within the refinery.

In contrast, implementations of the present disclosure relate to a process that introduces the quench liquids into the quench input line 111 at a second rate. The second rate is greater than the first rate. In some implementations of the present disclosure, the second rate can be twice the first rate. In some implementations of the present disclosure, the second rate can be more than twice the first rate. In some implementations of the present disclosure the second rate can be between two and five times the first rate. When the quench liquids are introduced into the quench input line 111 at the second rate the state of matter of the CVL 114 contents is different than when the quench liquids are introduced at the first rate.

When the quench liquids are introduced at the second rate, there is a larger volume per unit time of quench liquids present within the CVL 114, as compared to the first rate. This larger volume of quench liquids within the CVL 114 causes, directly or indirectly, a heat transfer and a mass transfer to occur within the CVL 114. This is in contrast with the heat transfer and mass transfer that occurs within the fractionator 112 when the quench liquid is introduced at the lower first rate. The heat transfer within the CVL 114 occurs as the cracked hydrocarbon vapors and solid coke-particles entrained therein are cooled by the quench liquids. However, because there is an increased volume of quench liquids, the heat transfer does not vaporize all of or substantially any of the quench liquids within the CVL 114. The implication of this heat transfer is that at least a part of if not substantially all of the quench liquids remains in a liquid state within the CVL 114. The mass transfer occurs with a significant portion of, or all of, the solid coke-particles being washed from the cracked hydrocarbon vapors into the quench liquid.

In other implementations of the present disclosure, the quench liquid is introduced into the CLV 114 based upon a ratio relative to the rate at which the coker input stream 108 is introduced into the coker unit 110. This ratio can be referred to as the two-phase ratio because it can result in a two-phase stream of fluids within the CVL 114, as described further below. The two-phase ratio can be based upon the quench liquid volume rate relative to the coker input stream volume rate, which can also be referred to as the feed throughput volume rate. In some implementations of the present disclosure the two-phase ratio can be within a range of between about 1:6.7 or about 1:8.2 or about 1:5.5 or about 1:6.7. In some implementations of the present disclosure the two-phase ratio is about 1:6.7.

In other implementations of the present disclosure, the rate of introducing the quench liquid into the CVL 114 can be determined based upon a volume percentage of the feed throughput rate. This percentage can be referred to herein as the two-phase percentage because it can result in a two-phase stream of fluids within the CVL 114, as described further below. In some implementations the quench liquid rate is between about 13.5% to about 16.5% of the feed throughput rate. In other implementations of the present disclosure, the quench liquid rate is about 15% of the feed throughput rate.

In some implementations of the present disclosure, the quench liquids are introduced based upon the source of the coker input stream 108. For example, if the coker input stream 108 is sourced from atmospheric topped bitumen, then the quench liquid can be introduced at a higher rate than if the coker input stream 108 is sourced from, for example, vacuum topped bitumen.

When the quench liquids are introduced based upon the second rate, the two-phase ratio or the two-phase percentage there is a flow of fluids within the CVL 114 with three states of matter: the cracked hydrocarbon vapors, the quench liquid and solid coker-particles entrained within the quench liquid. For the purpose of the present disclosure, the fluids within the CVL 114 are referred as a two-phase flow or a second rate CVL input. When the second rate CVL input enters the fractionator 112, the coker vapors ascend the fractionator 112 for separation into the various fractionator hydrocarbon products within the separation zone 120. The quench liquids and some or substantially most or substantially all of the solid coke-particles are separated from the coker vapors for example by gravity for collection within the lower zone 116.

Without being bound by any particular theory, introducing the quench liquid based upon the second rate, the two-phase ratio or the two-phase percentage can create the temperature and pressure environment within the CVL 114 to generate the two-phase flow within the CVL 114. When the two-phase flow enters the fractionator 112, the quench liquid and the solid coke-particles are gravity separated from the cracked hydrocarbon vapors, which can decrease the amount of solid coke-particles that become entrained within vapors that can ascend and foul the fractionator 112. In some implementations of the present disclosure, the introducing of the quench liquid based upon the second rate will prevent most or substantially all of the solid coke-particles from becoming entrained within the vapors the can ascend and foul the fractionator 112.

In some implementations of the present disclosure the extent of the gravity separation of the quench liquid and the solid coke-particles allows the wash zone 117 to operate at a lower rate, as compared to when the quench liquid is introduced at the first rate. For example, when the quench liquid is introduced at the second rate only one or only two or none of the spray headers 118 can be required to wash any solid coke-particles that are entrained within any hydrocarbon vapors that are ascending through the fractionator 112. This is in contrast with when the quench liquids are introduced at the first rate and two or all three levels of the spray headers 118A, 118B, 118C are spraying hydrocarbon wash liquids.

In some implementations of the present disclosure the extent of the gravity separation of the solid coke-particles allows the fractionator 112 to operate without a wash zone 118 for extended periods of time, for example, a few years and up to about 5 years.

Figure 2:
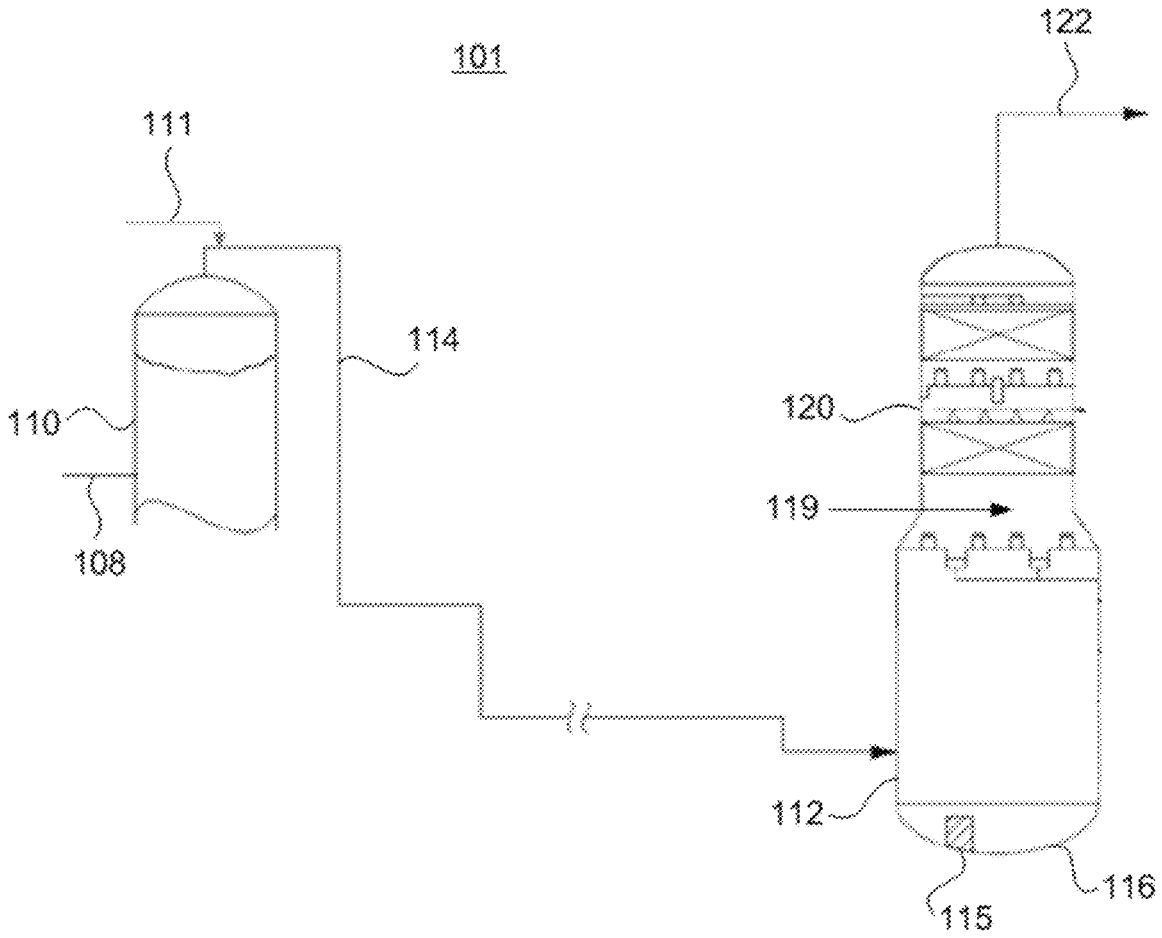
FIG. 2 is a schematic diagram that shows another example of a coker-fractionator unit in accordance with implementations of the present disclosure.

FIG. 2 shows another implementation of the present disclosure that relates to a fractionator 112 that does not have a wash zone 117. This implementation of the present disclosure can work when the quench liquid is introduced into the quench input line 111 at the second rate so that the second rate CVL input enters the lower zone 116 of the fractionator 112 and the quench liquid and solid coke-particles are separated from the cracked hydrocarbon vapors at or near the point where the CVL 114 enters the fractionator 112. In some implementations of the present disclosure, the coker fractionation unit 100 can operate using the second rate of introducing the quench liquid into the CVL 114 and maintain between about a 75% to about a 95% of the full operational production rate of the coker-fractionator unit 100 while producing fractionator hydrocarbon products that meet the specification requirements of downstream refinery processes and equipment.

Figure 3:
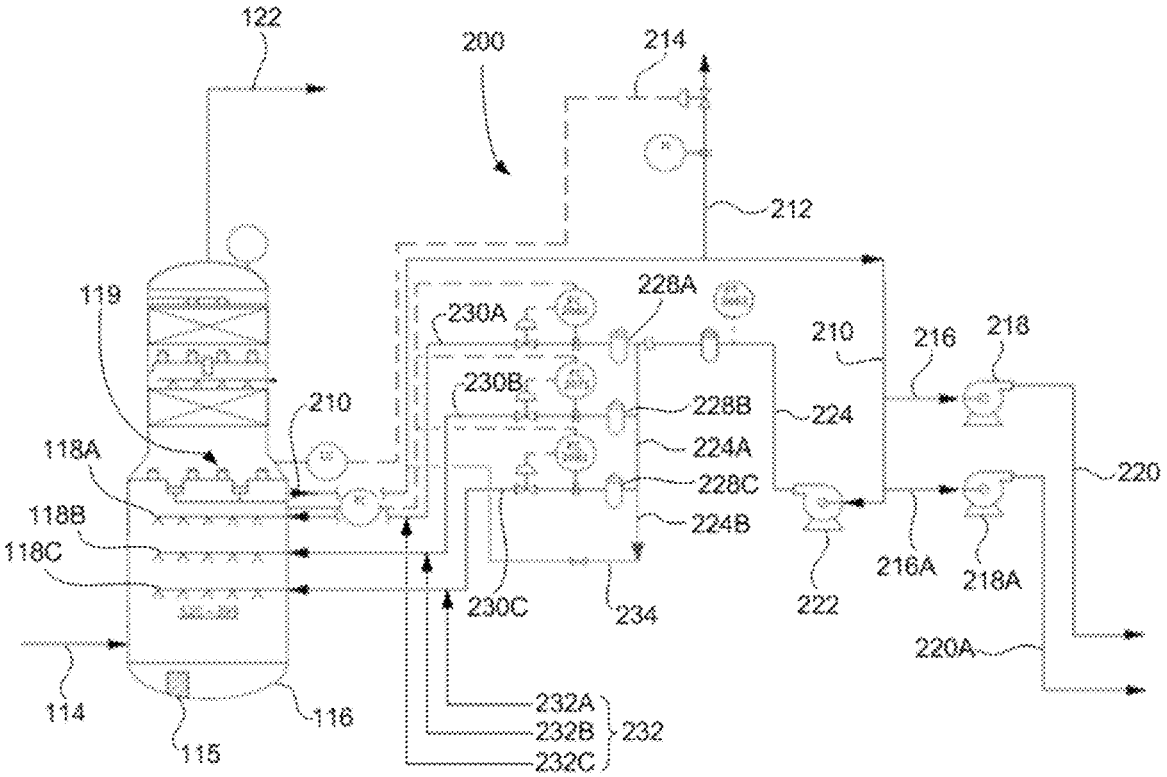
FIG. 3 is a schematic diagram that shows an example of a wash fluid-circulation system for use with the coker-fractionator unit of FIG. 1 in accordance with implementations of the present disclosure.

FIG. 3 shows another implementation of the present disclosure that relates to a wash-zone circulation loop 200 that is in fluid communication with the fractionator 112. In some implementations of the present disclosure the wash-zone recirculation loop 200 is a straight run, purging and flushing recirculation loop. The wash-zone circulation loop 200 includes a primary output line 210 from the capture zone 119. The primary output line 210 carries the heavy hydrocarbons that ascended the fractionator 112 past the wash zone 117 and were captured in the capture zone 119. In some instances the heavy hydrocarbons can cool and at least partially condense into a heavy hydrocarbon liquid within the capture zone 119 or within the primary output line 210. In some implementations of the present disclosure the heavy hydrocarbons within the primary output line 210 are partially liquid and partially vapor or the heavy hydrocarbons can be substantially all liquid. The primary output line 210 can be fluidly connected with a line 212 so that the contents of the primary output line 210 can be removed from the wash-zone recirculation loop 200 without any further processing or for further processing that occurs outside of the wash-zone recirculation loop 200.

The primary output line 210 is in fluid communication with one or more draw lines 216, 216A each of which is in fluid communication with a draw pump 218, 218A and a draw output line 220, 220A, respectively. The pumps 218, 218A can be any type of known pump that is suitable for pumping single-phase hydrocarbon fluids or multi-phase hydrocarbon fluids. In some implementations of the present disclosure the pumps 218, 218A are each a centrifugal pump.

Because the temperature within the primary output line 210 can be high enough to cause polymerization of the hydrocarbons therein, it may be desirable to draw off some of the contents of the primary output line 210 after the line 212 but before the contents of the primary output line 210 enter the remainder of the wash-zone recirculation loop 200. This draw off can occur via either or both of draw lines 216, 216A. The contents of the draw output lines 220, 220A can be processed further outside of the wash-zone recirculation loop 200.

The primary output line 210 is in fluid communication with a pump 222 that maintains or boosts the flow rate and/or pressure of the heavy hydrocarbon liquids within a secondary output line 224 that is downstream of the pump 222. The pump 222 can be any type of known pump that is suitable for pumping single-phase hydrocarbon fluids or multi-phase hydrocarbon fluids. In some implementations of the present disclosure the pump 222 is a centrifugal pump.

The secondary output line 224 includes a header region 224A that distributes the heavy hydrocarbon fluids to one or more spray header input lines. FIG. 3 shows one spray header input line that conducts heavy hydrocarbon fluids to each ring of the spray headers 118. For example, a spray header input line 230A is fluidly connected to the spray header 118A; a spray header input line 230B is fluidly connected to the spray header 118B; and, a spray header input line 230C is fluidly connected to the spray header 118C.

In some implementations of the present disclosure, the header region 224A includes an extension 224B that extends beyond the last of the input lines 230A, 230B, 230C. The extension 224B is in fluid communication with and forms part of a recirculation loop 234 that is in fluid communication with the primary output line 210. The extension 224B can reduce the accumulation of any solid coke-particles that are present in the heavy hydrocarbon fluid within the last of the input lines 230A, 230B, 230C. In particular, the extension 224B can provide a fluid path that allows some of the solid coke-particles to avoid moving into any of the input lines 230A, 230B, 230C, which reduces the amount of solid coke-particles that move therethrough. The extension 224B likely has the most impact on reducing the accumulation of solid coke-particles in input line 230C because in the absence of extension 224B, input line 230C would receive all of the solid coke-particles that did not enter either of the other input lines 230A and 230B. In other words, extension 224B allows an alternate fluid path so that some of the solid coke-particles can avoid the input lines 230A, 230B, 230C. Reducing the accumulation of solid coke-particles within the input lines 230A, 230B, 230C can reduce the fouling or clogging of the spray headers 118.

In some implementations of the present disclosure each header input line 230A, 230B, 230C includes a filter 228A, 228B, 228C respectively and collectively referred to herein as the filter 228. The filter 228 can be a strain guard or other type of pass-through filter member that can capture some or substantially all of the solid coke-particles that can be entrained in the heavy hydrocarbon fluids within the sprayer input lines 230A, 230B, 230C. The filters 228 also can reduce the accumulation of solid coke-particles within the input lines 230A, 230B, 230C.

In some implementations of the present disclosure the wash-zone circulation loop 200 includes the extension 224B, the recirculation loop 234 and the filter 228 for each input line 230. The extension 224B and the recirculation loop 234 can reduce fouling or clogging of the filters 228 caused by solid coke-particles, which can decrease the frequency at which the filters 228 require cleaning or replacement.

In some implementations of the present disclosure the wash-zone circulation loop 200 further includes a steam input line 232 that fluidly communicates steam into each of the spray header input lines 230. For example, a steam input line 232A is in fluid communication with the spray header input line 230A; a steam input line 232B is in fluid communication with the spray input line 230B; and, a steam input line 232C is in fluid communication with the spray input line 230C. The steam can be pressurized to about 135 to 165 pounds per square inch (psi). The steam can assist with cleaning nozzle heads of the spray headers 118.

In some implementations of the present disclosure the wash-zone circulation loop 200 includes a tertiary line 214 from the capture zone 119. The tertiary line 214 is in fluid communication with the line 212. The tertiary line 214 can be used to remove gas products from the capture zone 119 or to add the contents of line 212 back into the capture zone 119.

Figure 4:
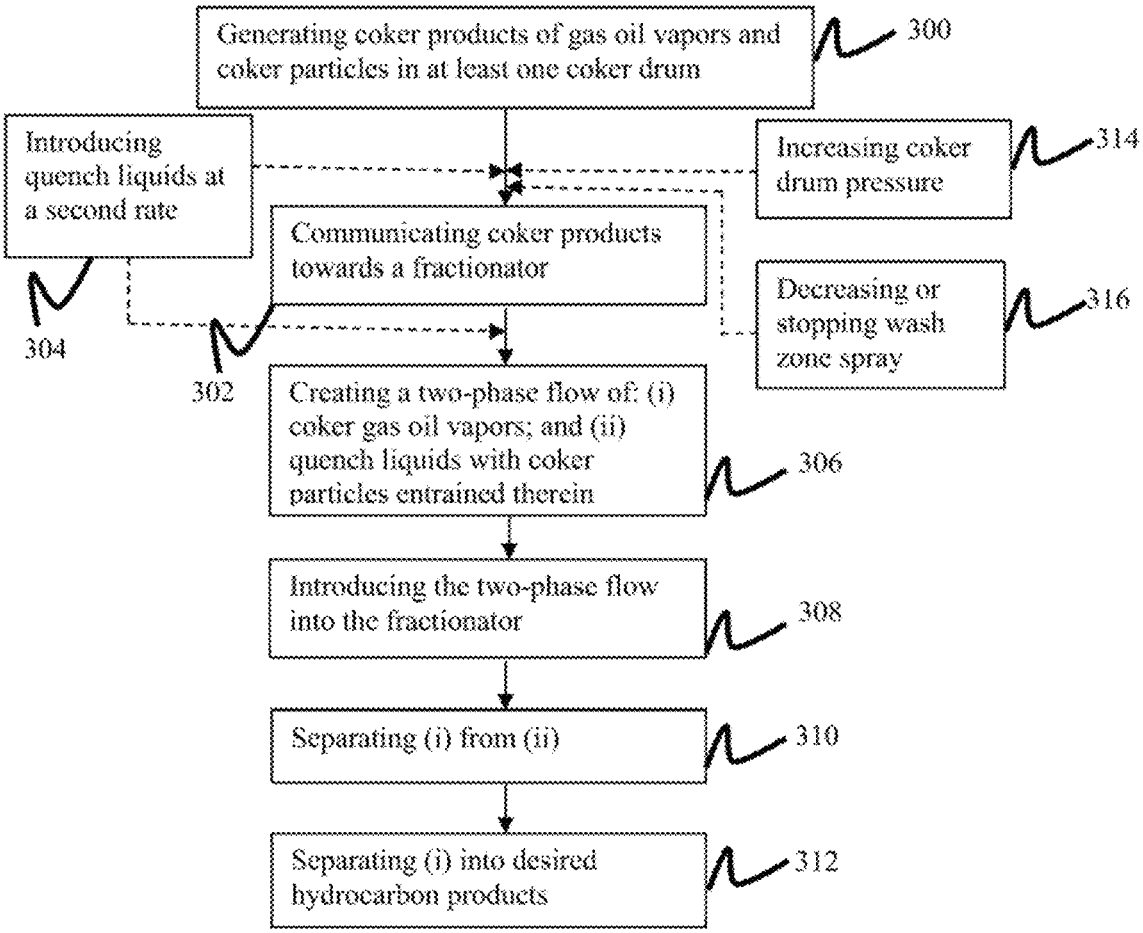
FIG. 4 is a logic flow chart that represents an example of a process for operating a coker-fractionator unit in accordance with implementations of the present disclosure.

FIG. 4 is a logic flow chart that shows an example of a process for operating a coker-fractionator unit according to implementations of the present disclosure. The process includes the steps of:

Generating coker products of cracked hydrocarbon vapors and solid coke-particles in at least one coker drum 300;

Communicating the coker products towards a fractionator 302;

Introducing quench liquids at a second rate 304 that is higher than a standard rate, this step is shown with a dashed line to show that the quench fluids can be introduced directly within the CVL 114 or upstream thereof. The second rate for introducing the quench liquids causes or at least contributes towards the next step. In some implementations of the present disclosure, the quench liquid can be introduced at more than one location along the CVL 114;

Creating a two-phase flow of (i) cracked hydrocarbon vapors; and (ii) quench liquids with solid coke-particles entrained therein 306;

Introducing the two-phase flow into the fractionator 308;

Separating (i) the cracked hydrocarbon vapors from (ii) the quench liquids with the solid coke-particles entrained therein 310; and Separating (i) the cracked hydrocarbon vapors into the desired hydrocarbon products by boiling point separation.

FIG. 4 also shows the optional steps (by dashed lines) of increasing the coker drum pressure 314 and decreasing or stopping the wash zone spray 316 within the fractionator. In the implementation of the present disclosure shown in FIG. 1 the wash zone spray can be stopped or decreased depending upon the resolution of the two-phases created in step 306. If there is a clear resolution of the two phases, then stopping the wash zone spray is an option. If there is not a clear resolution of the two-phases then some wash zone spray can be maintained to reduced or stop the ascent of solid coke-particles upward through the fractionator 112 and past the wash zone 117. In the implementation of the present disclosure shown in FIG. 2, step 316 is not necessary.

EXAMPLES

The examples below were designed for and implemented in a delayed coker system. As such, the term cracker hydrocarbon vapor can be referred to in the examples as "coker gas oil" or "CGO" and the fractionator products can generally be referred to in the examples as "gas oil" or "GO". In the examples, the phrase "FZGO spray flow" refers to the wash zone spray and "OVHD quench GO" refers to the rate at which the quench liquid is introduced into the CVL 114.

Example 1

Modelling Heat and Mass Transfer Parameters

PRO/II® modelling was used to evaluate any change in the GO 95% during different operating modes, and to generate stream properties for liquid and solid entrainment calculations with an EXCEL® spread-sheet based model (PRO/II is a registered trademark of Simulation Sciences, Inc. and EXCEL is a registered trademark of the Microsoft Corporation). The PRO/II base model was validated for 10.5 hours cycle (full rate) operation. The three spray headers 118A, 118B, 118C were modeled as one theoretical stage in the fractionator 112 operation and the CVL 114 with quench liquid was modeled as an equilibrium flash drum.

To model a scenario (i) that is without wash zone spray, the theoretical stage representing three spray rings was removed, and PRO/II model was adjusted to minimize the internal reflux flow from the GO draw tray close to about 10 BPH (the internal reflux has to be >0 for PRO/II to converge), this represents no wash zone spray.

Various quench flow rates without wash zone spray (scenario (i)) were assessed using PROII modelling, in order to produce GO with a normal 95% point of 943° F. at full GO rate, the quench flow rate into the CVL 114 can be increased to about 1650 BPH. Table 1 below summarizes the PROII modeling process data.

TABLE 1

Summary of PRO/II data.

| U2 Frac PROII modeling: | Today (reduced 10.5 hr): SCO of 244 KBPD Normal Operation: FZGO spray flow of 605 BPH, OVHD quench GO at 650 BPH. | Case 1 No FZGO spray, increase OVHD quench GO to 1255 BPH. | Case 2 No FZGO spray, increase OVHD quench GO to 1650 BPH. |
|---|---|---|---|
| CVL GO quench, BPH | 650 | 1255 | 1650 |
| FZGO spray, BPH | 605 | 0 | 0 |
| Average Drum Ovhd pressure, psig | 48.5 | 48.5 | 48.5 |
| Approximate vapour line DP, psi | 12.2 | 12.46 | 13.12 |
| Total Vapour Dwn/S of quill, SCFH | 10008845 | 10006027 | 10076319 |
| Total Liquid Dwn/S of quill, BPH | 203 | 913 | 1252 |
| Total Vapour at 52C-399 entry, SCFH | 10196829 | 10114752 | 10202228 |
| Total Liquid at 52C-399 entry, BPH | 0 | 653 | 965 |
| Temperature at 52C-399 inlet, deg F.: | 789 | 767.8 | 753.9 |
| Phase at 52C-399 inlet: | vapour | two | two |
| Flow regime | | annular | dispersed |
| GO 95% point | 943 | 958 | 943 |
| API | 13.1 | 12.5 | 13.8 |
| Frac Bot Recycle, BPH | 750 | 713 | 1035 |
| Frac Bot Recycle API | 5.69 | 6.14 | 6.77 |
| Flash Zone: | | | |
| T, deg F. | 782 | 768 | 748 |
| P, psig | 37.9 | 38.2 | 38.1 |
| Vapour flow, lb/hr | 2647824.4 | 2615170 | 2630099.3 |
| Vapour density, lb/ft3 | 0.396 | 0.398 | 0.401 |
| Liquid flow, lb/hr | 263112 | 0 | 0 |
| Liquid density, lb/ft3 | 47.9 | 47.6 | 48.8 |
| C Factor, CS, Ft/Sec | 0.240 | 0.237 | 0.235 |

It was then determined that the maximum available quench liquid flow rate could be about 1200 BPH after removing the nozzles off of the quench input line 111 and increasing the size of the quench pump impeller.

Based on the available quench liquid flow, the PRO/II models were adjusted to simulate a reduced production scenario. A 10% production rate reduction was applied as this was deemed as the lower limit of an economic operation. Since there is still some room to increase coke drum operating pressures at this reduced production rate, the PRO/II model also tested the increased operating coke drum pressure scenario. The Table 2 below shows the adjusted PROII results:

TABLE 2

Summary of adjusted PROII results.

| U2 Frac PROII modeling: | Today (reduced 10.5 hr): SCO of 244 KBPD Normal Operation: FZGO spray flow of 605 BPH, OVHD quench GO at 650 BPH. | Case 3: SCO of 219 KBPD (10% reduction) No FZGO spray, OVHD quench GO limit of 1200 BPH. U2 Coke at 12 hr cycle (90% of full rate) | Case 4: SCO of 219 KBPD (10% reduction) - Recommended operation when lose FZGO spray No FZGO spray, OVHD quench GO limit of 1200 BPH. U2 Coke at 12 hr cycle (90% of full rate), Drum pressure raise to 54 psig. Frac pressure matched. |
|---|---|---|---|
| CVL GO quench, BPH | 650 | 1200 | 1200 |
| FZGO spray, BPH | 605 | 0 | 0 |
| Average Drum Ovhd pressure, psig | 48.5 | 48.5 | 54 |
| Approximate vapour line DP, psi | 12.2 | 9.96 | 8.9 |

TABLE 2-continued

Summary of adjusted PROII results.

| U2 Frac PROII modeling: | Today (reduced 10.5 hr): SCO of 244 KBPD Normal Operation: FZGO spray flow of 605 BPH, OVHD quench GO at 650 BPH. | Case 3: SCO of 219 KBPD (10% reduction) No FZGO spray, OVHD quench GO limit of 1200 BPH. U2 Coke at 12 hr cycle (90% of full rate) | Case 4: SCO of 219 KBPD (10% reduction) - Recommended operation when lose FZGO spray No FZGO spray, OVHD quench GO limit of 1200 BPH. U2 Coke at 12 hr cycle (90% of full rate), Drum pressure raise to 54 psig. Frac pressure matched. |
|---|---|---|---|
| Total Vapour Dwn/S of quill, SCFH | 10008845 | 9098502 | 9095687 |
| Total Liquid Dwn/S of quill, BPH | 203 | 892 | 931 |
| Total Vapour at 52C-399 entry, SCFH | 10196829 | 9176822 | 9159666 |
| Total Liquid at 52C-399 entry, BPH | 0 | 707 | 783.5 |
| Temperature at 52C-399 inlet, deg F.: | 789 | 765 | 767 |
| Phase at 52C-399 inlet: | vapour | two | two |
| Flow regime | | annular | dispersed |
| GO 95% point | 943 | 956 | 950 |
| API | 13.1 | 12.5 | 13.8 |
| Frac Bot Recycle, BPH | 750 | 685 | 758 |
| Frac Bot Recycle API | 5.69 | 6.14 | 6.5 |
| Flash Zone: | | | |
| T, deg F. | 781.9 | 764.5 | 767 |
| P, psig | 37.9 | 37.4 | 44.7 |
| Vapour flow, lb/hr | 2647824.4 | 2364298 | 2333930 |
| Vapour density, lb/ft3 | 0.396 | 0.39 | 0.44 |
| Liquid flow, lb/hr | 263111.9 | 0 | 0 |
| Liquid density, lb/ft3 | 47.9 | 47.4 | 47.2 |
| C Factor, CS, Ft/Sec | 0.240 | 0.217 | 0.202 |

An Excel-based spread sheet model was established based upon historic data and upon the following assumptions: (i) the entrainment rate for micro-carbon (MCR) is same as the entrainment rate for other types of solid coke-particles, which can be calculated by particle balance, which can be due to a natural recycle entrainment; (ii) the entrainment rate is proportional to the C-factor value squared in both the coker drum vapor space and the wash zone; and (iii) there is a CVL dispersed flow regime at a fractionator inlet to produce more than 90% of droplets whose size are between about 100 μm to about 400 μm, or larger (i.e. to meet the condition where the Souders-Brown equation was developed). The C-factor is a key parameter that reflects the magnitude of solids/liquid entrainment within a fluid stream. Table 3 below summarizes the Excel sheet analysis.

TABLE 3

Summary of Excel sheet analysis.

| Production | Specs & Targets | Today | Constant Feed | Hold MCR @ 0.80% (4) | Maintain Particulates/ MCR (5) | Outage Limited | No FZGO spray, OVHD quench GO limit of 1200 BPH. U2 coker at 12 hr cycle (90% of full rate), drum pressure raised to 54 psig, frac pressure matched |
|---|---|---|---|---|---|---|---|
| Feed | 9050 bph | 8560 | 8560 | 7734 | 4736 | 8700 | 7892 |
| Quench | 3 × 230 bph | 3 × 215 | 3 × 550 | 3 × 450 | 3 × 300 | 3 × 560 | 3 × 400 |
| Spray | 600 bph | 605 | 0 | 0 | 0 | 0 | 0 |
| Flow Regime | vapour | vapour | dispersed | annular | annular | dispersed | dispersed |
| Coker AP | 13.9 psi | 12.2 | 13.1 | 10.7 | 4.0 | 13.5 | 8.9 |
| NR | 7.5% | 8.7% | 12.0% | 12.0% | 12.0% | 12.0% | 9.7% |
| UP2 Yield | 80.0% | 80.0% | 79.7% | 79.7% | 79.7% | 79.7% | 78.8% |
| SCO | 260KBPSD | 244 | 236 | 213 | 130 | 240 | 219 |
| Lost Production | | | −3% | −13% | −47% | −2% | −10% |

TABLE 3-continued

Summary of Excel sheet analysis.

| Production | Specs & Targets | Today | Constant Feed | Hold MCR @ 0.80% (4) | Maintain Particulates/ MCR (5) | Outage Limited | No FZGO spray, OVHD quench GO limit of 1200 BPH. U2 coker at 12 hr cycle (90% of full rate), drum pressure raised to 54 psig, frac pressure matched |
|---|---|---|---|---|---|---|---|
| Quality | | | | | | | |
| GO 95%, *F | 930°-945° F. | 943 | 943 | 943 | 943 | 943 | 950 |
| GO API | min 12 | 13.1 | 13.8 | 13.8 | 13.8 | 13.8 | 13.8 |
| MCR | 0.75-0.80% | 0.65% | 0.85% | 0.80% | 0.65% | 0.86% | 0.88% (6) (0.82%) |
| Particulates | 60 ppm | 15 | 49(3) | 40 | 15 | 51 | 41.0 (6) (31.6) |
| FZ C-factor (U2) | | 0.240 | | | | | 0.202 |
| FZ C-factor (U1) | | 0.217 | | | | | |
| Coke Drum C-factor change(ratio) | | 1 | | | | | 0.878 |
| Quench Prorate | | | | 497 | 304 | 559 | |
| Entrainment est. (1) | | 1.92% | 6.27% | 5.12% | 1.92% | 6.48% | 4.44% |
| Entrained MCR (2) | | 0.09% | 0.29% | 0.24% | 0.09% | 0.30% | 0.18% |

From Table 3, the recommended operating scenario would produce coke heavy GO with 41 ppm of particles and 0.82% wt. of MCR, which is acceptable by the specifications for a downstream hydro-treater. If, taking account of the reduction of entrainment from coke drum due to increased pressure/reduced C-factor, the solid coke-particles in the CGO could further decrease to about 32 ppm. The downsides of this operating scenario are also shown in Table 3: 10% of production loss and an overall liquid yield reduction of 1.2% volume due to the increased coke drum pressure.

In an attempt to validate the assumption that a long CVL 114 can be treated as an equilibrium stage when the quench liquid is introduced at a higher rate to cause a two-phase flow condition within the CVL a follow-up CFD (Computational Fluid Dynamics) model was conducted. The CFD study focused on two critical locations in CVL: (1) a segment of horizontal 24-inch pipe and the quench liquid injection location within the CVL 114. The quench liquid flow rate was increased to 400 BPH so the total quench liquid flow will be 1200 BPH for the entire plant (same condition as PROII case 3 above). Both the cases with and without the quench nozzle were examined for comparison. The conclusion of CFD study is the quench performance is adequate with injection nozzle removed. The quench liquid leaving the quench input line 111 is broken up by the CGO flow and the quench liquid travels in an annular flow pattern within the 24-inch pipe. The CFD analysis indicate that the heat transfer and quench performance will be efficient within the CVL 114 and a two-phase equilibrium can be reached.

Example 2

Plant Test

A plant test was conducted for 8 hours to test the operating parameters that will allow a coker-fractionator unit 100 operate with reduced wash zone functionality or no wash zone functionality.

During the plant test the plant operating parameters were analyzed and compared to the coker-fractionator unit's 100 full rate operation. The coker-fractionator unit in these examples had three pairs of coker drums 110 that were all fluidly connected to a common CVL 114 by a header. The quench input line 111 was positioned upstream of the header for each pair of coker drums 110.

The plant test was performed as follows:

Step 1-The coker rate, which refers to the rate at CGO was removed from the coker drum 110, was initially reduced to 80% of full capacity to about 7120 barrels per hour (bph) (7120 bph is equal to about 198 thousand barrels per day SCO (KBPD SCO)) over about 5 hours. SCO is an acronym for synthetic crude oil that refers to the production of CGO to GO. A CGO baseline sample was taken at about 5 hours and 45 minutes after the initial coker rate reduction.

Step 2-The coker drum pressure was increased by raising the suction pressure of an inline wet-gas compressor. The average drum pressures were between about 45 and about 46 pounds per square inch gauge (psig). In this coker-fractionator unit one coker drum had a fouled outlet nozzle that caused one coker drum pressure to increase to about 53 to about 54 psig.

Step 3-The flow rate of introducing quench liquid into the quench input line 111 was increased to the second rate of about 1050 bph. Due to the limits of the quench liquid pumps' capacity, multiple pumps were run in parallel to achieve the second rate. The wash zone 117 spray flow was first reduced to 275 bph, and then switched to steam mode with no hydrocarbon wash fluid flowing through the spray headers 118.

Step 4-For eight hours the coker-fractionator unit 100 was operated steady without any wash zone 117 spray flow. During operations without wash zone 117 spray flow, the coker-fractionator unit's K performance indicators (KPIs) stayed within the specifications and targets. For example the gas oil draw tray (Tray #1) within the capture zone 119 has an under-pan temperature of between about 735° F. and about 745° F. and the pool temperature within the lower zone 116 was between about 670° F. and 675° F.

Step 5-The last CGO sample for the plant test was collected and then the wash zone 117 spray was resumed and the rate at which the quench liquid was introduced into the CVL 114 was reduced back to the first rate.

Table 4 below summarizes the plant test time line, the coker fractionator unit 100 operating parameters and the CGO sample results.

TABLE 4

Summary of plant test run timelines, coker rate and CGO sample results.

| Time | Particulates (mg/l) | Microcarbon (wt %) | Vanadium (ppmw) | IGO 95% point, ° F. | Coker Rate (bph) | Rates % of the full capacity |
|---|---|---|---|---|---|---|
| 09:45 (base line) | 7 | — | — | 944 | 7300 | 82 |
| 12:00 (1st sample after wash zone spray is offline) | 11.3 | — | — | — | 7120 | 80 |
| 14:00 | 4.3 | 0.64 | — | — | 7120 | 80 |
| 16:00 | 8.3 | — | 0.40 | 936.20 | 7415 | 84 |
| 17:00 | 8 | — | — | — | 7430 | 84 |
| 18:00 | 8.3 | 0.68 | 0.41 | 949.50 | 7950 | 90 |
| 19:00 | 4.7 | 0.69 | — | — | 7950 | 90 |
| 22:50 (wash zone spray online) | 4.3 | — | — | — | 6500 | 73 |

In order to analyze the plant test run results and to better understand the plant test performance, operating parameters were obtained; GO sample results were obtained and parameters were compared among three scenarios: (i) no wash zone spray; (ii) full rate operation with top spray in service, and (iii) the recommended operating mode from the Example 1 above. Table 5 below summarizes the fractionator hydrocarbon product quality results:

TABLE 5

Summary of plant test run timelines, coker rate and CGO sample results.

| Scenario | Particulates (mg/l) | Microcarbon (wt. %) | Vanadium (ppmw) | IGO 95% point, ° F. | Coker Rate (bph) | Rates % of the full capacity |
|---|---|---|---|---|---|---|
| (i) Non-spray test run, average | 7.5 | 0.67 | 0.405 | 943 | 7498 | 85 |
| (ii) Normal full rate operation with top spray ring in service, average in 2016 | 21.5 | 0.69 | 0.421 | 933 | 8818 | 99 |
| (iii) Projected results for non-spray ring operation in Example 1 | ≤32.0 | ≤0.82 | — | ≤950 | 8010 | 90 |

The scenario (i) with no wash zone spray achieved acceptable fractionator product qualities. The content of particles and microcarbon are all much lower than typical full rate operation with the top spray ring in service. Therefore, scenario (i) was also better than the predicted value from scenario (iii). The 95% point ° F. is between the full rate operation (scenario (ii)) and the predicted value (scenario (iii)).

The coke drum pressure and lower zone 116 pressures and temperatures for scenario (i) are close to that for scenario (ii), and lower than those recommended in scenario (iii).

During scenario (i), the rate at which quench liquids were introduced into the CVL can increase vapor-liquid contact in the CVL 114 and improve the mass transfer process within the CVL 114 line to compensate for the loss of wash zone 117 spray. However the contact between liquids and vapor in the CVL 114 cannot be as uniform and efficient as occurs in the wash zone 117 when there is wash zone 117 spray occurring. This discrepancy can explain that the GO 95% point ° F. in scenario (i) was higher than during scenario (ii) (943° F. vs. 933° F.) as seen in Table 5 above.

The presence and types of solid coke-particles are likely a result of entrainment from the top of the coke drum 110 through to the wash zone 117.

To calculate C-factors value for the various operation scenarios, a PRO/II simulation was applied to assess the vapor and liquid properties within the coker drum 110 and the wash zone 117 for different operating scenarios. The calculated C-factor values are summarized in Table 6 and Table 7 below:

TABLE 6

Coker drum C-factor values.

| | Coke Drum Pair Number # | | |
|---|---|---|---|
| | 301/302 | 303/304 | 313/314 |
| Scenario (i) | No wash zone spray, 85% of full GO rate, quench liquid flow rate 1049 BPH. | | |
| C - Factor (modified Cv), Ft/Sec | 0.428 | 0.435 | 0.440 |
| Scenario (ii) | Normal full rate wash zone spray rate of 550 BPH, 99% of full GO rate, quench liquid flow rate 837 BPH. | | |
| C - Factor (modified Cv), Ft/Sec | 0.489 | 0.497 | 0.498 |
| Scenario (iii) | No wash zone spray, quench liquid flow rate 1200 BPH, 90% of full coke rate, drum pressure at 54 psig. | | |
| C - Factor (modified Cv), Ft/Sec | 0.434 | 0.434 | 0.433 |

TABLE 7

| Wash Zone C-factor | |
|---|---|
| Scenario | C - Factor (Cs), Ft/Sec |
| (i) No wash zone spray, 85% of full GO rate, quench liquid flow rate 1049 BPH. | 0.205 |
| (ii) Normal full rate wash zone spray rate of 550 BPH, 99% of full GO rate, quench liquid flow rate 837 BPH | 0.239 |
| (iii) No wash zone spray, quench liquid flow rate 1200 BPH, 90% of full coke rate, drum pressure at 54 psig. | 0.198 |

In summary, through the analysis of the sample results, operating parameter and C-factor values the following observations were made:

Running the coker-fractionator unit under scenario (i) without any wash zone spray was successful from about 85% to about 90% of the GO full rate while the GO quality can be maintained on specification.

The estimation for 90% of full rate run in scenario (iii) from Example 1 matched well with test run result for GO 95% point ° F., particulates and micro-carbon.

I claim:

1. A process for operating a coker-fractionator unit comprising steps of:

a) generating a coker product that comprises a cracked hydrocarbon vapor and solid coke-particles;

b) introducing a quench liquid into the coker product such that a two-phase flow is generated comprising the cracked hydrocarbon vapor and the quench liquid, wherein at least some of the solid coke-particles become entrained in the quench liquid;

c) providing the two-phase flow into a fractionator;

d) separating by gravity the cracked hydrocarbon vapor from the quench liquid and the solid coke-particles entrained therein; and e) decreasing or stopping a wash zone spray within the fractionator.

2. The process of claim 1 further comprising a step e) of separating desired hydrocarbon products from the cracked hydrocarbon vapor by boiling-point separation.

3. The process of claim 1, wherein the coker product is generated in a coker drum, the process further comprising a step f) of increasing pressure in the coker drum.

4. The process of claim 1, wherein the step b) further comprises introducing the quench liquid at a rate of between about 800 barrels per hour and about 1400 barrels per hour.

5. The process of claim 4, wherein the step b) further comprises introducing the quench liquid at a rate of between about 1000 barrels per hour and about 1300 barrels per hour.

6. The process of claim 1, wherein the step b) further comprises introducing the quench liquid based upon a two-phase ratio that is a quench liquid volume rate relative to a feed throughput volume rate.

7. The process of claim 6, wherein the two-phase ratio is about 1:6.7.

8. The process of claim 6, wherein the two-phase ratio is about 1:8.2.

9. The process of claim 6, wherein the two-phase ratio is about 1:5.5.

10. The process of claim 1, wherein the step b) further comprises introducing the quench liquid based upon a two-phase volume percentage of a feed throughput volume rate.

11. The process of claim 10, wherein the two-phase volume percentage is between about 13.5% to about 16.5% of the feed throughput volume rate.

* * * * *